United States Patent [19]

Cheskis et al.

[11] 3,993,479

[45] Nov. 23, 1976

[54] COPPER BASE ALLOY

[75] Inventors: Harvey P. Cheskis; Stanley Shapiro, both of New Haven, Conn.

[73] Assignee: Olin Corporation, New Haven, Conn.

[22] Filed: Aug. 4, 1975

[21] Appl. No.: 601,261

[52] U.S. Cl. ..... 75/160; 148/32

[51] Int. Cl.[2] ..... C22C 9/01

[58] Field of Search ..... 75/162, 160, 164; 148/11.5 C, 32

[56] References Cited

UNITED STATES PATENTS

| | | | |
|---|---|---|---|
| 2,270,716 | 1/1942 | Morris | 75/162 |
| 2,907,653 | 10/1959 | Holzwarth et al. | 75/162 |
| 3,297,497 | 1/1967 | Eichelman, Jr. et al. | 75/162 |
| 3,366,477 | 1/1968 | Eichelman, Jr. et al. | 75/162 |
| 3,416,915 | 12/1968 | Mikawa | 75/162 |

FOREIGN PATENTS OR APPLICATIONS

| | | | |
|---|---|---|---|
| 672,263 | 5/1952 | United Kingdom | 75/162 |

*Primary Examiner*—W. Stallard

*Attorney, Agent, or Firm*—Robert H. Bachman; David A. Jackson

[57] ABSTRACT

An improved copper base alloy having good high temperature properties, such as hot rollability, creep strength and stress rupture life. The alloy contains from about 2 to 9.5% aluminum, from about 0.001 to 3% silicon, and a grain refining element selected from the group consisting of iron from about 0.001 to 5%, chromium from about 0.001 to 1%, zirconium from about 0.001 to 1%, cobalt from about 0.001 to 5% and mixtures thereof. In addition, the alloy contains titanium in an amount from about 0.2 to 1%.

9 Claims, No Drawings

COPPER BASE ALLOY

BACKGROUND OF THE INVENTION

The present invention relates to the series of copper base alloys containing aluminum and silicon and one or more grain refining elements. It is common practice to add grain refiners to various solid solution, single phase alloys for the purpose of maintaining a fine grain material during processing from the original cast material to the final wrought product. The grain refiner may be added to improve processing and/or to improve properties. In most cases a grain refiner serves to maintain uniform properties over a compositional range and over a range of processing conditions.

Alloys of the foregoing type are, however, often prone to rapid grain boundary failure under stress over the temperature range of from 450° to 950° C. During casting and subsequent direct chill solidification of these alloys, residual stresses may result which subsequently lead to grain boundary sliding, void formation and grain boundary cracking when the alloy is heated for hot rolling, as, for example, in the range 870° to 900° C. The defective grain boundaries and low strength of the grain boundaries often result in cracking during hot rolling. This cracking results in significant material losses when the alloy is subsequently processed into a strip product.

It is, therefore, a principal object of the present invention to provide an improved copper base alloy characterized by good hot rollability, creep strength and stress rupture life.

It is a still further object of the present invention to provide an improved grain refined copper base alloy containing aluminum and silicon which is not prone to rapid grain boundary failure under stress at elevated temperatures.

It is a still further object of the present invention to provide an improved copper base alloy as aforesaid which is particularly suitable for processing into wrought products, such as strip, without significant material losses.

Further objects and advantages of the present invention will appear hereinbelow.

SUMMARY OF THE INVENTION

In accordance with the present invention it has now been found that the foregoing objects and advantages may be readily obtained. The alloy of the present invention consists essentially of from about 2 to 9.5% aluminum, from about 0.001 to 3% silicon, from about 0.2 to 1% titanium, and a grain refining element selected from the group consisting of iron from about 0.001 to 5%, chromium from about 0.001 to 1%, zirconium from about 0.001 to 1%, cobalt from about 0.001 to 5% and mixtures thereof.

The foregoing alloy is particularly suitable as a wrought product and does not yield significant material losses when processed into strip. Furthermore, it has been found that the addition of titanium overcomes the difficulty of the aforesaid alloy with respect to grain boundary failure under stress at elevated temperatures.

DETAILED DESCRIPTION

The copper base alloy of the present invention contains from about 2 to 9.5% aluminum and preferably from about 2 to 5% aluminum. In addition, the copper base alloy of the present invention contains from about 0.001 to 3% silicon and preferably from about 1 to 3% silicon.

In addition, as indicated above, the alloy of the present invention contains one or more grain refining elements selected from the group consisting of iron from about 0.001 to 5.0%, preferably from about 0.1 to 2%, chromium from about 0.001 to 1%, preferably from about 0.1 to 0.8%, zirconium from about 0.001 to 1.0%, preferably from about 0.1 to 0.8%, cobalt from about 0.001 to 5.0% and preferably from about 0.1 to 2.0% and mixtures thereof. The preferred grain refining element is cobalt.

The alloy of the present invention should contain less than 1% zinc.

In addition, as indicated above, the alloy of the present invention contains from 0.2 to 1.0% titanium and preferably from 0.3 to 0.5% titanium. The titanium range in the alloy of the present invention is influenced by several factors. Naturally, titanium is an expensive material and it is desirable to use no more than necessary. The improvement in stress rupture life tends to level off as one approaches 1% titanium. Furthermore, titanium is a reactive element and the more that is required in the alloy the more one must allow for losses during melting. Also, excessive amounts of titanium are undesirable since titanium forms objectionable oxides and carbides.

It has been found that the alloy of the present invention is particularly applicable to CDA Alloy 638 containing about 2.5 to 3.1% aluminum, about 1.5 to 2.1% silicon, about 0.25 to 0.55% cobalt, and the balance copper.

As indicated hereinabove it is a principal object of the invention to improve the high temperature response of the aforesaid alloys and thereby improve the hot rolling performance of the alloy. It has been found in accordance with the present invention that significant improvements in high temperature rupture life of the aforesaid alloys have been obtained through the addition of titanium in the aforesaid amounts.

The titanium addition should be made to the molten metal prior to casting. The cast material may then be processed in accordance with standard processing to provide a wrought product, such as strip material. For example, the material may be heated to hot rolling temperature, hot rolled, cold rolled and annealed, with one or more cycles of cold rolling and annealing, if desired, to provide either an annealed product or a product in the temper rolled condition. It has been found in accordance with the present invention that the resultant strip product is characterized by no significant material losses, as was the case prior to the titanium addition. In addition, the titanium addition has been found to significantly overcome the heretofore rapid grain boundary failure under stress at an elevated temperature.

Naturally, additional additives may be utilized in the alloy of the present invention if desired in order to emphasize particular characteristics or to obtain particularly desirable results.

The present invention will be more readily understandable from the following illustrative examples.

EXAMPLE I

A copper base alloy containing about 2.8% aluminum, 1.8% silicon, 0.4% cobalt and the balance copper was prepared by induction melting in air under a charcoal cover and chill cast in a 2 × 4 × 4 inch mold.

One-half inch diameter tensile samples were prepared and tested at various temperatures and stresses in a stress rupture test to be discussed hereinbelow. The alloy prepared in this Example I is identified as Alloy 1.

EXAMPLE II

A copper base alloy was prepared as in Example I having the same composition as Alloy 1 except that 0.335% titanium was added to the molten metal prior to chill casting. Tensile samples ½ inch in diameter were prepared and tested at various temperatures and stresses in a stress rupture test to be described hereinbelow. The alloy described in this Example II is identified as Alloy 2.

EXAMPLE III

Alloys 1 and 2 in the form of ½ inch diameter tensile samples were tested at various temperatures and stresses in a stress rupture test. Rupture lives were measured in a standard creep-rupture test in which the alloy sample was heated to the desired temperature, a stress applied, and the time to rupture measured. Table A below indicates the temperatures used, the stress applied and the resulting rupture lives for Alloys 1 and 2. The significant improvement of the alloy of the present invention is quite apparent with respect to high temperature rupture response.

TABLE A

| Alloy | Wt. Percent Titanium in the Alloy | Test Temperature | Stress - psi | Time to Failure - Hours |
|---|---|---|---|---|
| 1 | 0 | 650° C | 3500 | 3.4 |
| 1 | 0 | 850° C | 1000 | 10.2 |
| 2 | 0.335 | 650° C | 3500 | 65.1 |
| 2 | 0.335 | 850° C | 1000 | 280.3 |

EXAMPLE IV

A commercially prepared sample of CDA Alloy 638 was obtained having the following composition: aluminum about 2.8%, silicon about 1.8%, cobalt about 0.4%, balance copper.

This material was remelted by induction heating in air under a charcoal cover and chill cast into a 2 × 4 × 4 inch mold. Tensile samples ½ inch in diameter were prepared and tested at various temperatures and stresses in a stress rupture test as described in Example III. The aforesaid alloy is identified as Alloy 3.

The same commercially produced CDA Alloy 638 was remelted and various amounts of titanium was added to the molten alloy prior to chill casting. These alloys are identified as Alloys 4–8. Stress rupture testing was then performed as in Example III. The resultant data is shown in Table B below.

TABLE B

| Alloy | Wt. Percent Titanium in the Alloy | Test Temperature | Stress - psi | Time to Failure - Hours |
|---|---|---|---|---|
| 3 | 0 | 650° C | 3500 | 0.2 |
| 3 | 0 | 850° C | 1000 | 0.9 |
| 4 | 0.2 | 650° C | 3500 | 4.0 |
| 4 | 0.2 | 850° C | 1000 | 10.0 |
| 5 | 0.3 | 650° C | 3500 | 10.0 |
| 5 | 0.3 | 850° C | 1000 | 25.0 |
| 6 | 0.35 | 650° C | 3500 | 11.5 |
| 6 | 0.35 | 850° C | 1000 | 27.0 |
| 7 | 0.47 | 650° C | 3500 | 25.0 |
| 7 | 0.47 | 850° C | 1000 | 169.0 |
| 8 | 0.82 | 650° C | 3500 | 47.0 |
| 8 | 0.82 | 850° C | 1000 | <400 |

EXAMPLE V

Alloy 2 of the present invention was tested and found to have excellent hot rollability with no apparent residual stresses. The alloy was processed to strip material by hot rolling, cold rolling and annealing and yielded a good strip product without substantial material losses.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A copper base alloy strip having improved stress rupture life and hot rollability consisting essentially of from about 2 to 9.5% aluminum, from about 0.001 to 3% silicon, from about 0.2 to 1% titanium, a grain refining element selected from the group consisting of iron from about 0.001 to 5.0%, chromium from about 0.001 to 1%, zirconium from about 0.001 to 1%, cobalt from about 0.001 to 5% and mixtures thereof, and the balance copper.

2. An alloy according to claim 1 containing from about 2 to 5% aluminum.

3. An alloy according to claim 2 containing from about 1 to 3% silicon.

4. An alloy according to claim 3 containing from about 0.3 to 0.5% titanium.

5. An alloy according to claim 1 wherein the grain refining element is cobalt.

6. An alloy according to claim 1 wherein the minimum amount of said grain refining element is 0.1%.

7. An alloy according to claim 1 containing less than about 1% zinc.

8. An alloy according to claim 1 in the temper rolled condition.

9. An alloy according to claim 1 wherein the aluminum content is from 2.5 to 3.1%, the silicon content is from 1.5 to 2.1% and wherein the grain refining element is cobalt in an amount from 0.25 to 0.55%.

* * * * *